US012799642B2

(12) United States Patent
Flachenecker et al.

(10) Patent No.: US 12,799,642 B2
(45) Date of Patent: Nov. 17, 2026

(54) ADHESIVE RIBBON YARN

(71) Applicant: PHP FIBERS GMBH, Obernburg (DE)

(72) Inventors: Andreas Flachenecker, Essen (DE); Christian Vieth, Wörth (DE); Volker Siejak, Duisburg (DE); Daniel Hehn, Estenfeld (DE)

(73) Assignee: PHP FIBERS GMBH, Obernburg (DE)

( * ) Notice: Subject to any disclaimer, the term of this patent is extended or adjusted under 35 U.S.C. 154(b) by 410 days.

(21) Appl. No.: 18/027,295

(22) PCT Filed: Sep. 28, 2021

(86) PCT No.: PCT/EP2021/076647
§ 371 (c)(1),
(2) Date: Mar. 20, 2023

(87) PCT Pub. No.: WO2022/069471
PCT Pub. Date: Apr. 7, 2022

(65) Prior Publication Data

US 2023/0366133 A1 Nov. 16, 2023

(30) Foreign Application Priority Data

Sep. 29, 2020 (EP) ..... 20198959

(51) Int. Cl.
*D02G 3/40* (2006.01)
*D02G 3/16* (2006.01)
*D02G 3/44* (2006.01)

(52) U.S. Cl.
CPC ..... *D02G 3/402* (2013.01); *D02G 3/16* (2013.01); *D02G 3/446* (2013.01); *D10B 2505/12* (2013.01)

(58) Field of Classification Search
None
See application file for complete search history.

(56) References Cited

U.S. PATENT DOCUMENTS

| | | | | |
|---|---|---|---|---|
| 3,461,025 | A | 8/1969 | Coleman et al. | |
| 7,470,453 | B1 * | 12/2008 | Lewis | D06N 3/186 427/407.1 |
| 2006/0207202 | A1 * | 9/2006 | Newton | C09J 7/21 52/255 |
| 2012/0285596 | A1 * | 11/2012 | Hrabal | H02K 7/1846 152/450 |
| 2015/0037559 | A1 * | 2/2015 | Dollase | C08L 57/02 524/505 |
| 2015/0167207 | A1 | 6/2015 | Bongartz et al. | |
| 2015/0204077 | A1 * | 7/2015 | Mikulecky | D03D 3/005 442/187 |
| 2021/0002795 | A1 | 1/2021 | Bongartz et al. | |

FOREIGN PATENT DOCUMENTS

| | | | |
|---|---|---|---|
| EP | 0330980 | A2 | 9/1989 |
| GB | 868954 | A | 5/1961 |
| JP | 2003-002990 | A | 1/2003 |
| WO | 2013/117728 | A1 | 8/2013 |
| WO | 2015/104178 | A1 | 7/2015 |
| WO | 2020/132663 | A1 | 6/2020 |

OTHER PUBLICATIONS

Nov. 22, 2021 International Search Report issued in International Patent Application No. PCT/EP2021/076647.

* cited by examiner

*Primary Examiner* — Shawn Mckinnon
(74) *Attorney, Agent, or Firm* — Oliff PLC

(57) ABSTRACT

A ribbon yarn having an upper side and a lower side, filaments and at least one binder material, the binder material binding the filaments to one another and the upper side and/or the lower side of the ribbon yarn having a pressure-sensitive adhesive. The filaments of the ribbon yarn can consist only of one material or of different materials and they can be arranged in one layer or in multiple layers. The pressure-sensitive adhesive can be applied on the upper side and/or lower side of the ribbon yarn or can be a constituent of the binder material.

15 Claims, No Drawings

ADHESIVE RIBBON YARN

The invention relates to a ribbon yarn which can be used as a raw material for textile reinforcements in technical products such as, e.g. fibre composites, vehicle tyres or for the manufacture of fabrics, in particular for flexible structures such as, e.g. airbags.

Ribbon yarns typically consist of multifilament yarns that are spread in such a way that the individual filaments preferably run next to each other and thus form a filament string whose cross-section is not round but flattened. Typical ribbon yarns are in the shape of ribbons, comparable to audiotape or adhesive tape, for example. The filament string is usually held in shape by binder material, also known to the person skilled in the art as matrix material or fixing agent, with which the multifilament yarn is impregnated.

Ribbon yarns are characterized by the fact that they have a non-round yarn cross-section. In an embodiment, the yarn cross-section of the ribbon yarn has two sides parallel to each other. In an embodiment, the yarn cross-section of the ribbon yarn is rectangular. In an embodiment, the yarn cross-section of the ribbon yarn is trapezoidal. In an embodiment, the yarn cross-section of the ribbon yarn is in the shape of a flattened oval with two parallel sides and rounded edges. In an embodiment, the yarn cross-section of the ribbon yarn is in the shape of an ellipse.

Ribbon yarns are usually spooled after the binder material has been provided and stored and transported in the form of reels, which can weigh up to 15 kg and can contain a ribbon yarn strand up to 100 km long. Prior art ribbon yarns are characterized by the fact that they can easily slip on the reel during winding and unwinding, but also during vibrations of a stored reel. Slipped ribbon yarns can massively hinder the winding and unwinding process and furthermore lead to knotting, tangling or tearing of the yarn. Last but not least, the economic damage caused by the slipping of ribbon yarns on the reel or during winding and unwinding is immense, because parts of the ribbon yarn are no longer usable and have to be discarded. In addition, obstructions caused by slipped, knotted or tangled ribbon yarns mean a stop to the production or processing process and thus further economic losses.

It is therefore the object of the invention to provide a ribbon yarn which cannot slip during winding and unwinding or during transport or storage in reel form.

The object is achieved by a ribbon yarn having an upper side and a lower side, filaments and a binder material, wherein the binder material contains a substantial proportion of thermoplastic materials, wherein the upper and lower sides of the ribbon yarn contain binder material, and wherein the binder material binds the filaments to one another, characterized in that the upper side and/or the lower side of the ribbon yarn comprises a pressure-sensitive adhesive.

By spreading the filaments, the distribution of the binder material can be improved, resulting in significantly better impregnation, even if no subsequent pressure treatment is carried out.

For the purpose of the present application, "impregnation" is understood to mean any process in which one material is incorporated into another material having pores or interstices.

Filaments within the meaning of the present application are structures whose length is a multiple of their thickness. The term "filaments" can therefore be understood to mean all types of fibres. In particular, however, filaments are understood to be fibres of a particularly long length. A typical filament has a length of one metre or more, but the length can also be several hundred and even several thousand metres.

In an embodiment, the filaments comprise a substantial proportion of thermoplastic polymers such as polyamides, polyesters, polyolefins or mixtures thereof.

Polyamides are all polymers in which the monomer units are linked by amide bonds. This includes in particular polycondensation products of aliphatic diamines such as hexamethylenediamine, pentamethylenediamine or tetramethylenediamine and aliphatic dicarboxylic acids such as adipic acid, sebacic acid, azelaic acid or dodecanoic acid. Furthermore, polyamides are also understood to be polycondensation products of aromatic dicarboxylic acids such as terephthalic acid, isophthalic acid or phthalic acid with the aliphatic diamines already mentioned (polyphthalamides) or also with aromatic diamines such as paraphenylenediamine (aramides). Since in the polyamides mentioned above, the monomers contain either two amino or two acid groups, they are also called "polyamides of the AA-SS type". Furthermore, polyamides are also understood to be polycondensation products from aminocarboxylic acids such as 11-aminoundecanoic acid or from lactams such as s-caprolactam or laurinlactam. Since monomers containing both acid and amino groups are present in this type of polyamide, they are also called "polyamides of the AS type". "Copolyamides" within the meaning of the present application are understood to be either polyamides of the AA-SS type which have two or more amino components and/or two or more acid components or polyamides of the AS type which have two or more different monomer components with acid and amino group.

Polyester is understood to mean all polymers in which the monomer units are linked by ester bonds. This includes in particular polycondensation products of aliphatic diols such as ethylene glycol, trim ethylene glycol or 1,4-butanediol and aromatic dicarboxylic acids such as terephthalic acid, isophthalic acid or phthalic acid. Furthermore, polyesters are also understood to be polycondensation products from hydroxycarboxylic acids such as lactic acid or from lactones such as s-caprolactone. "Copolyesters" within the meaning of the present application are understood to be either polyesters having two or more diol components and/or two or more diacid components, or else polyesters having two or more different monomer components with one acid group and one amino group.

For the purposes of the present application, "polyolefins" are understood to mean all polymers obtained essentially by polymerisation of monounsaturated hydrocarbons, in particular ethene, propene or butene.

In an embodiment, the filaments comprise a substantial proportion of inorganic fibres such as glass fibres, basalt fibres, carbon fibres or metal wires.

In an embodiment, the filaments comprise a substantial proportion of pulp-based cellulose fibres such as viscose, lyocell, cupro or pulp-based cellulose fibres produced using ionic liquids.

In an embodiment, the filaments of the ribbon yarn according to the application comprise different materials such as a mixture of thermoplastic and inorganic fibres such as, for example, polyamide 6 and glass fibre, polyamide-6,6 and glass fibre, polyamide-6 and aramid or polyamide 6 and carbon fibres. The filaments can be mixed from different materials or be in different layers. Such ribbon yarns are known to the person skill in the art as "hybrid rovings". Corresponding materials are described in European patent applications EP2812471 and EP3092112. In the present application, the term "hybrid roving" is subsumed under the term "ribbon yarn".

In the present application, the term "binder material" is understood to mean the entirety of the solid non-fibrous material located between the filaments of the ribbon yarn. In an embodiment, the binder material is a thermoplastic polymer. In an embodiment, the binder material is based on a thermoplastic copolyamide. In an embodiment, the melting point of the thermoplastic copolyamide may be 120° C. to 150° C. In a further embodiment, the binder material may be thermoplastic copolyester. In an embodiment, the binder material may be polyolefins or functionalized polyolefins such as a polypropylene maleic anhydride graft polymer. In an embodiment, the binder material may be, for example, based on polysiloxanes. Polysiloxanes that contain vinyl groups in the main chain or in the side chains are particularly suitable for this. In an embodiment, the binder material has thermoset or elastomeric properties. For the purposes of the present invention, "based" is understood to mean the circumstance that the binder material contains the corresponding substance in a substantial proportion and that the corresponding substance also contributes a substantial proportion to the function of the binder material, namely binding the individual filaments of the ribbon yarn to one another. A substantial proportion within the meaning of the present application is understood to mean that the corresponding material constitutes at least 50% by weight of the binder material.

In addition, the binder material may contain other components, such as plasticisers, dyes, pigments, pressure-sensitive adhesives, antistatic agents, UV inhibitors or antioxidants.

The binder material can be added to the ribbon yarn in different forms. In particular, spread filament strings can be provided with the binder material by impregnation from solutions, melts or emulsions. Impregnation by spraying is also possible.

In the present application, a pressure-sensitive adhesive is understood to mean materials that have a high tack, i.e. that form adhesive bonds with objects that come into contact with the material in question within a very short time. For the purposes of the present application, strong adhesion, i.e. strong, permanent adhesion of the object in contact with the pressure-sensitive adhesive, is not desired. For the purposes of the present application, a pressure-sensitive adhesive is also expressly understood to include adhesives that lose their tack over time (e.g. through evaporation of the solvent or dispersant).

Possible pressure-sensitive adhesives are polymers or copolymers based on acrylates, namely based on 2-ethylhexlacrylate, isoamyl acrylate, hydroxymethacrylate, isooctyl acrylate, acrylic acid, methyl methacrylate or butyl acrylate. The polymers or copolymers used as pressure-sensitive adhesives may also contain styrene, natural rubber, polyterpene resin, polyisoprene, styrene-butadiene rubber, styrene-butadiene rubber, isobutene-isoprene rubber, acrylonitrile-butadiene rubber, chloroprene rubber, polyvinyl acetate or polydiphenyl disiloxane. In an embodiment, the pressure-sensitive adhesive contains swellable acrylate beads. In an embodiment, the pressure-sensitive adhesive contains a solvent or swelling agent such as water, an alcohol such as ethanol, methanol, 1-propanol or 2-propanol, a ketone such as acetone or methyl ethyl ketone, or an alkane such as n-hexane, n-heptane or petroleum ether. In an embodiment, the component added as a pressure-sensitive adhesive retains its adhesive strength even after heat treatment of the ribbon yarn at, for example, 180° C. In an embodiment, the pressure-sensitive adhesive is such that it loses its adhesive property over time, for example, through exposure to light, atmospheric oxygen or evaporation of a solvent or swelling agent.

In an embodiment, the amount and type of pressure-sensitive adhesive are selected so that the resulting adhesive bond can be released by applying a force of approximately 0.01 mN/tex. Approximately in this context means a deviation upwards and downwards of 50% each. This can decisively improve both the attachment of the ribbon yarn to a coil core and the cohesion of the wound-on ribbon yarn on the reel. At the same time, neither the unwinding nor the processability of the ribbon yarn is significantly restricted.

This ensures that the adhesive force is able to hold the weight of a one-metre long piece of a ribbon yarn with a fineness of x tex, as the following calculation may illustrate:

One metre of yarn with a fineness of xtex has a mass of $$\frac{x}{1000}\,\mathrm{g}$$

and accordingly a weight force of $$\frac{9.81x}{1000}\,\mathrm{mN},$$

which corresponds to 0.00981 mN/tex and rounded up 0.01 mN/tex.

In an embodiment, the binder material contains the pressure-sensitive adhesive as a component.

In an embodiment, the binder material is selected such that the binder material as a whole is a pressure-sensitive adhesive. In this embodiment, the binder material may be an acrylate-based polymer or copolymer. Possible monomers are 2-ethylhexlacrylate, isoamyl acrylate, hydroxymethacrylate, isooctyl acrylate, acrylic acid, methyl methacrylate or butyl acrylate. The binder material may contain swellable acrylic beads. Furthermore, the binder material can also be a material based on rubbers such as natural rubber, polyisoprene, polyterpene resin, styrene-butadiene rubber, isobutene-isoprene rubber, acrylonitrile-butadiene rubber or chloroprene rubber. In addition, a binder material based on polyvinyl acetate or polydiphenyl disiloxane is also conceivable.

The binder material may be such that by wetting and/or activating it with a solvent such as water, an alcohol such as ethanol, methanol, 1-propanol, 2-propanol, a ketone such as acetone or methyl ethyl ketone, an alkane such as n-hexane, n-heptane or petroleum ether, it permanently or temporarily takes on the property of a pressure-sensitive adhesive.

In an embodiment, the pressure-sensitive adhesive forms at least one layer on the ribbon yarn. In further embodiments, two or more layers are also possible, which can be on different sides of the ribbon yarn and/or directly on top of each other.

In an embodiment, the pressure-sensitive adhesive is present on the upper and/or the lower side of the ribbon yarn. The pressure-sensitive adhesive can be present on the surface of the ribbon yarn both in the form of a closed layer and in the form of continuous or discontinuous patterns such as, e.g. stripes, dots or other geometric shapes.

In a further embodiment, the ribbon yarn may be completely impregnated with the pressure-sensitive adhesive.

The pressure-sensitive adhesive not only prevents the ribbon yarn from slipping during transport and/or storage on the coil, but also during winding and/or unwinding.

In an embodiment, the ribbon yarn according to the invention may comprise two or more layers of filaments. In an embodiment, the two or more layers of filaments include filaments of different materials, wherein layers of filaments do not interpenetrate. In an embodiment, multi-layered ribbon yarns can thus be produced which contain, e.g., two layers of filaments made of polyolefin, polyester or polyamide, between which a layer of filaments made of glass fibres, metal wires, basalt fibres, carbon fibres or aromatic polyamide fibres are embedded. In a further embodiment, filaments of different materials such as, for example, glass fibre and polyamide 6 or glass fibre and polypropylene may be included in a common layer in the ribbon yarn. Ribbon yarns that contain filaments made of different materials are also known to the expert as "hybrid rovings".

In an embodiment, the ribbon yarn according to the invention is wrapped in a plastic film after winding as protection against undesirable particles such as dust, which adhere particularly well due to the adhesive properties of the ribbon yarn. In an embodiment, the plastic film is a polyethylene film. In an embodiment, the plastic film is a multi-layer polyethylene film. In an embodiment, the plastic film is a multi-layer polyethylene film which is provided with a pressure-sensitive adhesive on the inner side or whose inner side is sticky due to its material composition, while the outer side is smooth, the inner side being the side of the polyethylene film facing the wound-on ribbon yarn. An embodiment is a plastic film that retains its shape and at the same time prevents the adjacent ribbon yarn layers from falling off, but does not restrict its complete handling. This is especially the case when the coil wrapped in the film is pulled off from the inside.

In order to meet these requirements, it is advantageous if the adhesive force of the ribbon yarn according to the invention is adjusted so that it is lower than the force with which the yarn is pulled off the coil.

The application also relates to a method for producing a ribbon yarn comprising the steps of laying out multifilaments arranged in parallel, arranging them in ribbon form and fixing them by applying one or more thermoplastic binder materials and subsequently winding up the yarn, characterized in that a pressure-sensitive adhesive is applied to the upper and/or lower side of the ribbon yarn or in that at least one thermoplastic binder material is a pressure-sensitive adhesive.

For the production of ribbon yarns, multifilament yarns are preferably used in which the filaments are not connected to each other in order to ensure problem-free spreading of the multifilament yarn.

The binder material(s) can be applied in different ways. In an embodiment, the binder material or a precursor thereof may be applied from a polymer solution in a suitable solvent. The spread yarn is then passed through the solution and enabled to absorb the binder material from the liquid. By evaporating the solvent, the binder material or the precursor thereof then encloses the individual filaments of the spread yarn. If a precursor of a binder material, such as, e.g., a thermoset or elastomeric binder material, has been applied, the evaporation of the solvent is followed by a curing or vulcanisation step in which the applied material is heated and/or irradiated with visible or UV light to convert the precursor into the binder material.

In an embodiment, the binder material or a precursor thereof may be applied from a melt or in pure liquid form. The spread yarn is then passed through the liquid and enabled to take up the binder material or precursor thereof. The absorbed material then wets the individual filaments of the yarn. If the binder material is thermoplastic, the filaments are bonded together by cooling. If a precursor of a binder material, e.g. a thermoset or elastomeric binder material, has been applied, this is followed by a curing or vulcanisation step in which the applied material is heated and/or irradiated with visible or UV light to convert the precursor to the binder material.

In a further embodiment, the binder material or a precursor thereof may also be applied to the spread yarn in particle form. Here, impregnation is possible from a particle suspension in water or another suitable liquid, through which the spread yarn is passed. It is also possible to impregnate with a polymer powder, which is applied to the spread yarn, for example, from a fluidized bed or via atomiser guns. If the binder material is applied to the yarn in particle form, this is followed by at least one heating step in which any liquids are evaporated and the particles are melted and, if necessary, a precursor of binder materials is converted to the actual binder material. The melt of the particles then wraps itself around the individual filaments of the spread yarn and binds them together—possibly after the binder material has been formed from the precursor. The at least one heating step can be carried out in an oven, on heated godets, by means of an infrared heater or by calendaring over a heated roller pair or a heated roller trio.

In a further embodiment, a precursor of the binder material or the binder material itself may also be applied to the yarn in droplet form. Here, impregnation is possible from an emulsion in water or another suitable liquid through which the yarn is passed. It is also possible to impregnate by spraying a liquid onto the yarn. The application in droplet form can be followed by a heating step in which any liquids are evaporated and the precursor is converted to the actual binder material. The droplets consolidate into a liquid that wraps around the single filaments of the yarn and, if necessary, binds them together after the binder material has formed from the precursor. The at least one heating step can be carried out in an oven, on heated godets, by means of an infrared heater or by calendaring over a heated roller pair or a heated roller trio.

A precursor of the binder material is understood to be substances that are solidified by a subsequent processing step such as heating or irradiation with visible or UV light, thus forming the binder material.

In an embodiment of the method according to the invention, the winding of the yarns bound by means of binder material is carried out without twisting.

In an embodiment, a pressure-sensitive adhesive is applied to at least one side of the yarn between the binding and the winding of the yarn.

In an embodiment, the pressure-sensitive adhesive may be a pressure-sensitive adhesive based on swellable acrylate beads. In an embodiment, the pressure-sensitive adhesive is applied to the ribbon yarn in liquid, dissolved, dispersed or viscous form. Possible methods are application from a bath through which the ribbon yarn is passed, application via a transfer roller or by spraying. The pressure-sensitive adhesive can be applied selectively or as a closed layer. The adhesive strength of the applied pressure-sensitive adhesive can be controlled by the amount or the area wetted with the pressure-sensitive adhesive.

If the pressure-sensitive adhesive is applied in dissolved or dispersed form, the solvent or dispersion agent can optionally be removed by drying, e.g. in a possibly heated air stream, and/or by negative pressure.

In an embodiment, the application of the pressure-sensitive adhesive may be performed immediately prior to the winding of the ribbon yarn or, if pressure-sensitive adhesive has already been applied, repeated immediately prior to the application of the pressure-sensitive adhesive. Furthermore, it is possible not to remove any solvent or dispersion agent from the pressure-sensitive adhesive applied immediately before winding, in order to improve the adhesion of the ribbon yarn to the coil.

In another embodiment, pressure-sensitive adhesive already applied to the ribbon yarn may be activated prior to winding by wetting with water or another solvent such as an alcohol such as ethanol, methanol, 1-propanol or 2-propanol, a ketone such as acetone or methyl ethyl ketone, an alkane such as n-hexane or n-heptane, or petroleum ether to improve the adhesion of the ribbon yarn to the coil.

In an embodiment of the method according to the invention, the binder material comprises a pressure-sensitive adhesive or the binder material is a pressure-sensitive adhesive.

The application also relates to a fibre-based reinforcement for a pneumatic vehicle tyre comprising a ribbon yarn according to the invention.

The application also relates to an airbag comprising a ribbon yarn according to the invention.

The invention claimed is:

1. Ribbon yarn having an upper side and a lower side, filaments, and a binder material, wherein the binder material is contained in the upper and lower sides of the ribbon yarn, and wherein the binder material binds the filaments to one another, wherein the upper side and/or the lower side of the ribbon yarn comprises a pressure-sensitive adhesive, and wherein the pressure-sensitive adhesive is such that it results in an adhesive bond between two ribbon yarns according to the invention, which bond is to be released by applying a force of approximately 0.01 mN/tex.

2. Ribbon yarn according to claim 1, wherein the filaments comprise a substantial proportion of thermoplastic polymers.

3. Ribbon yarn according to claim 1, wherein the filaments comprise a substantial proportion of inorganic fibres.

4. Ribbon yarn according to claim 1, wherein the binder material is copolyester, copolyamide, silicone or mixtures thereof.

5. Ribbon yarn according to claim 1, wherein the pressure-sensitive adhesive is based on acrylates, rubber or silicones or mixtures thereof.

6. Ribbon yarn according to claim 1, wherein the pressure-sensitive adhesive is included in the binder material or the binder material is a pressure-sensitive adhesive.

7. Ribbon yarn according to claim 1, wherein the pressure-sensitive adhesive forms at least one layer on the ribbon yarn.

8. Ribbon yarn according to claim 1, wherein the pressure-sensitive adhesive contains swellable acrylic beads.

9. Method for producing a ribbon yarn, comprising the steps of a. laying out continuous filaments b. spreading of the continuous filaments c. binding of the continuous filaments by applying one or more binder materials d. winding up the bound yarn, wherein a pressure-sensitive adhesive is applied to the upper and/or lower side of the ribbon yarn or in that at least one thermoplastic binder material is a pressure-sensitive adhesive, and wherein the applied pressure-sensitive is selected and applied such that it results in an adhesive bond between two layers of the wound yarn, which bond is to be released by applying a force of approximately 0.01 mN/tex.

10. Method according to claim 9, wherein the pressure-sensitive adhesive is applied to the yarn from a bath or via a roller or is sprayed onto the yarn and subsequently dried.

11. Method according to claim 9, wherein the pressure-sensitive adhesive is applied immediately prior to winding.

12. Reinforcement for a pneumatic vehicle tyre containing a ribbon yarn according to claim 1, or containing a ribbon yarn produced by a method for producing a ribbon yarn, comprising the steps of a. laying out continuous filaments b. spreading of the continuous filaments c. binding of the continuous filaments by applying one or more binder materials d. winding up the bound yarn, wherein a pressure-sensitive adhesive is applied to the upper and/or lower side of the ribbon yarn or in that at least one thermoplastic binder material is a pressure-sensitive adhesive.

13. Airbag for a pneumatic vehicle tyre containing a ribbon yarn according to claim 1, or containing a ribbon yarn produced by a method for producing a ribbon yarn, comprising the steps of a. laying out continuous filaments b. spreading of the continuous filaments c. binding of the continuous filaments by applying one or more binder materials d. winding up the bound yarn, wherein a pressure-sensitive adhesive is applied to the upper and/or lower side of the ribbon yarn or in that at least one thermoplastic binder material is a pressure-sensitive adhesive.

14. Ribbon yarn according to claim 2, wherein the thermoplastic polymers are selected from the group consisting of polyamides, polyesters, polyolefins and mixtures thereof.

15. Ribbon yarn according to claim 3, wherein the inorganic fibres are selected from the group consisting of glass fibres, basalt fibres, carbon fibres and metal wires.

* * * * *